US005501054A

United States Patent [19]

Soltis et al.

[11] Patent Number: 5,501,054

[45] Date of Patent: Mar. 26, 1996

[54] BOLTED WOOD CONNECTIONS

[75] Inventors: Lawrence A. Soltis, Mt. Horeb; Robert J. Ross, Madison, both of Wis.

[73] Assignee: The United States of America as represented by the Secretary of Agriculture, Washington, D.C.

[21] Appl. No.: 204,114

[22] Filed: Mar. 1, 1994

[51] Int. Cl.[6] ..... E04C 3/42

[52] U.S. Cl. ..... 52/730.7; 52/309.2; 52/366; 52/731.1; 52/733.2; 52/DIG. 7; 428/77; 428/94

[58] Field of Search ..... 52/727, 728, 730.7, 52/92.3, 93.1, 309.2, 309.15, 787, 366, 367, 745.19, 733.2, DIG. 7; 428/77, 78, 106, 528, 61, 255, 94

[56] References Cited

U.S. PATENT DOCUMENTS

| | | | |
|---|---|---|---|
| 2,821,941 | 2/1958 | Reed | 52/376 |
| 3,316,684 | 5/1967 | Proudfoot | 428/106 |
| 3,650,795 | 3/1972 | Willingham | 117/5.1 |
| 4,242,406 | 12/1980 | El Bouhnini et al. | 428/236 |
| 4,303,707 | 12/1981 | Prior | 427/397 |
| 4,387,546 | 6/1983 | Kurita et al. | 52/730.7 |
| 5,074,092 | 12/1991 | Norlander | 52/730.7 X |
| 5,135,793 | 8/1992 | Socha | 428/74 |
| 5,362,545 | 11/1994 | Trugley | 428/96 |

*Primary Examiner*—Carl D. Friedman
*Assistant Examiner*—Christopher Todd Kent
*Attorney, Agent, or Firm*—Janet I. Stockhausen; M. Howard Silverstein; John D. Fado

[57] ABSTRACT

A reinforced structural member, a process for manufacturing the reinforced structural member, and a method of connecting the reinforced structural members to one another are presented. The reinforced structural member includes a reinforcing material which is bonded to a wooden substrate in areas of anticipated connection of the reinforced structural member. The reinforcing material may comprise a fiberglass sheet, a wood laminate sheet, a coating of epoxy resin, or a combination of any of the foregoing.

11 Claims, 4 Drawing Sheets

BOLTED WOOD CONNECTIONS

FIELD OF THE INVENTION

The present invention relates to wooden structural members used in construction. More specifically, the invention relates to bolted connections between such structural members. In particular, the invention is directed to the reinforcement of wooden structural members in the area of bolted connections.

DESCRIPTION OF THE PRIOR ART

In many commercial applications of structural members, one end of a structural member is connected to another member by means of a bolted connection. Typically, a hole is drilled through each of the structural members at the point of connection, and a bolt is inserted through each of the holes, respectively, and secured.

Failures of wooden structural members under load most often occur near the bolted connection due to the local stresses at these points. Failures can result from either axial or longitudinal forces on the bolt relative to the member (i.e., forces approximately perpendicular to the wood grain toward the side of the member, as depicted in FIG. 1, or forces approximately in the direction of the wood grain toward the end of the member, as depicted in FIG. 2). With either type of force, the failure mode is essentially brittle fracture, since wood does not exhibit any significant yield properties. Such catastrophic failure of bolted wooden structural members occurs without prior warning and manifests itself as a crack extending from the bolt hole to the nearest end of the structural member.

Currently, such catastrophic failures of bolted structural materials used in commercial applications are prevented by conservative design. Commercial structural specification, such as National Forest Products Association's National Design Specification for Wood Construction, specify the "end distances," "edge distances" and spacing requirements (for various structural geometries and various bolt configurations) which will adequately carry a specified design load. Such design specifications also account for the inherent inconsistencies associated with the non-homogeneous grain structures of wood.

Although the conservative design practices currently used to ensure the safety of bolted wood connections are adequate, increasing demand for structural lumber and the corresponding increases in price suggest a need for more efficient use of wood resources. Furthermore, the brittle fracture failure mechanism associated with bolted wood connections affords no warning of an eminent failure.

Similar concerns exist with respect to the overall load carrying capabilities of wooden structural members. Many prior art techniques are known for reinforcing wood structural members in order to improve their overall load carrying capacity and to reduce the amount of deflection when such members are under load.

Metals such as steel or aluminum, in the form of plates, rods or wires have been used to reinforce wooden structural members and the joints between them. For example, U.S. Pat. Nos. 4,485,606 to Gottlieb and 4,659,604 to Lambuth, disclose the use of metal plates as a structural reinforcement for the joints of wooden trusses. U.S. Pat. No. 5,050,366 to Gardner et al. discloses the use of steel rods as structural reinforcement for a wood laminate structural beam. Similarly, U.K. Patent Application 2,134,956A of Oates discloses the use of multiple steel rods bonded with epoxy resting in a longitudinal groove cut into a natural wood timber. Further, steel and aluminum plates have been placed between wood laminations, and have also been bonded with epoxy adhesives onto the tension faces of glulam, as summarized in Plevris and Triantafillou "FRP-Reinforced Wood as Structural Material" *Journal of Materials in Civil Engineering*, 4(3) (Aug. 1992).

Composite materials have also been used as reinforcing materials for wooden structural members. For example, U.S. Pat. No. 4,430,373 to Hammarberg discloses the use of glass-fiber threads internal to wood particle boards. Fiberglass has been used in the faces of wood core sandwich panels. "Analysis of Wood-Fiberglass Composite Beams Within and Beyond the Elastic Region," Biblis, E. J., Forest Products Journal, *Forest Products Journal,* 1965. Fiberglass in sheet form has also been used as an external reinforcement of plywood. "Plywood Overlaid with Fiberglass-Reinforced Plastic Durability and Maintenance," Mitzner, Raymond C., *American Plywood Association Laboratory Report* 119, Part 3, 1973. In addition, thin sheets of fiber-reinforced plastic have been externally bonded to the tension zones of wooden structural members using epoxy resins. Plevris and Triantafillou (Supra.); Triantafillou and Deskovic, "Prestressed FRP Sheets as External Reinforcement of Wood Members", *Journal of Structural Engineering,* 118(5) (May, 1992). Typically, the fiber-reinforced plastic sheets are made of unidirectional, continuous carbon fibers bonded into an epoxy matrix. Plevris and Triantafillou (Supra.). Each of these prior art uses of composite materials to reinforce wooden structural members is directed towards improving the overall strength, stiffness and ductility characteristics of the members.

Significantly, none of these prior art methods for reinforcing wooden structural members are suitable for the reinforcement of bolted connections. Metal mechanical reinforcements are difficult to use in field applications, since they require handling and installation of both the structural member and the reinforcement device. In addition, the degree of reinforcement is limited to the amount of stress transferable from the wood structural member to the reinforcement. Furthermore, metal reinforcement materials such as steel add considerable weight and are subject to corrosion. Although aluminum reinforcements are lighter and relatively corrosion resistant, they are more expensive.

Composite reinforcement materials for wooden structural members also have disadvantages. Reinforcements directed toward increasing the overall strength of the member, such as those using fiber-reinforced plastic, as suggested by Plevris and Triantafillou (Supra.), are inefficient with respect to the amount of reinforcement material needed and the time required to apply the reinforcement. Hence, the prior art methods of composite reinforcement are more expensive in terms of application time and material.

SUMMARY OF THE INVENTION

The present invention is directed to a structural member, in which a reinforcing material is bonded to a wooden substrate in areas of anticipated connections. The structural member includes a wooden substrate having a hole for receiving a connector and a reinforcing material bonded to the wooden substrate. The reinforcing material also contains an opening for the connector and is bonded to the wooden substrate such that the opening in the reinforcing material is aligned with the hole in the wooden substrate.

The present invention is also directed to a process for manufacturing a reinforced wooden structural member, in which a wooden substrate is selected, areas of anticipated connections on the wooden substrate are identified, and a reinforcing material is bonded to the wooden substrate in the areas of the anticipated connections.

The present invention is further directed to a method of connecting a reinforced wooden structural member to other structural members, in which a reinforced wooden structural member comprising a wooden substrate and a reinforcing material bonded to the wooden substrate in an area of anticipated connections is selected, holes are drilled through the reinforced wooden structural member in the area of anticipated connections, and the reinforced wooden structural member is connected to another structural member.

The present invention is directed to yet another method of connecting a reinforced wooden structural member to other structural members, in which a wooden structural member is selected, holes are drilled through a connection area located on the wooden structural member, a reinforcing material is bonded to the connection area of the wooden structural member such that it covers the holes contained in the wooden structural member, the reinforcing material located over the holes in the wooden structural member is cut or drilled out such that the holes in the reinforcing material are of the same circumference and directly aligned with the holes in the wooden structural member, and the resulting reinforced wooden structural member is connected to another structural member by connecting the holes contained in the reinforced structural member to the other structural member.

The present invention is directed to still another method of connecting a reinforced structural member to other structural members, in which holes are drilled into a wooden structural member in areas of anticipated connections, holes having the same circumference as those in the wooden structural member are precut or predrilled into a reinforcement sheet composed of reinforcing material, the reinforcement sheet is bonded to the wooden structural member in the area of anticipated connections such that the holes contained in the wooden structural member are directly aligned with the holes contained in the reinforcement sheet, and the resulting reinforced wooden structural member is connected to another structural member by connecting the holes contained in the reinforced wooden structural member to the other structural member.

The present invention is additionally directed to a structural member, a method for manufacturing a reinforced wooden structural member and a method of connecting a reinforced wooden structural member to other members, in which the reinforcing material comprises a fiberglass sheet, a wood laminate sheet or a coating of epoxy resin, and in which the reinforcing material is bonded to the wooden substrate with an epoxy resin.

The reinforced wooden structural member disclosed in the present invention is advantageous over prior art wooden structural members, which are non-reinforced, mechanically reinforced or composite-reinforced, in two aspects. First, the disclosed structural member has an improved load carrying capability at the point of connection to another structural member. As a result, a more efficient use of wood resources is possible since connection points can be placed nearer to the sides and ends of the members, thereby reducing the overall dimensions of the structural member for a given connection design load. Alternatively, the allowable load for a given end distance would be larger. Further, when multiple connections are necessary, these connections can be placed in closer proximity to each other while still maintaining the integrity of the structural member. Second, the disclosed structural member will not fail catastrophically at the point of connection under brittle fracture without a prior warning of such failure. The present invention would fail first in a ductile or elastic failure mechanism, and would therefore allow detection of pending failure by visual observation of plastic deformation associated with the reinforcing material or by devices such as strain gauges.

The reinforced wooden structural member of the present invention is also advantageous over prior art mechanically reinforced wooden structural members. The disclosed reinforced wooden structural member is lighter, not subject to corrosion, and less expensive than metal reinforced structural members. Additionally, the structural member of the present invention is more suitable for use in field applications.

The reinforced wooden structural member of the present invention is also advantageous over prior art composite-reinforced wooden structural members. The disclosed reinforced wooden structural member is more efficient in regards to the amount of reinforcement material and the time required for manufacturing, and hence is less expensive. The disclosed invention is also significantly less expensive than fiber-reinforced-plastic (FRP) composite reinforced structural members since less expensive reinforcing materials may be used. Further, the present invention is more suitable for field application than FRP type composite reinforcements.

The present invention has application where a wooden structural member is connected to another structural member and the point of connection is under an axial and/or longitudinal loading. Non-limiting examples of such applications include: construction applications such as for prefabricated homes, trusses, stairs, cantilevered joists, decks, scaffolds; furniture; and playground equipment.

Further objects, features and advantages of the invention will be apparent from the following detailed description when considered in conjunction with the accompanying drawings.

DETAILED DESCRIPTION OF THE INVENTION

Figure 2:
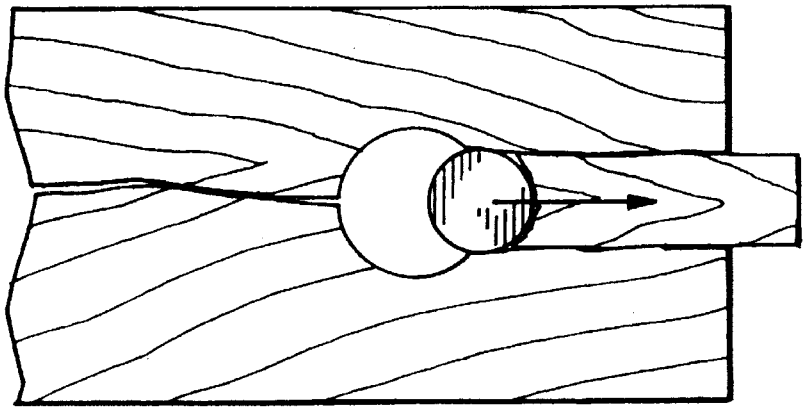
FIG. 2 is a prior art top plan view of a nonreinforced end of a wooden structural member undergoing a force loading in the longitudinal direction which results in a catastrophic failure of the wooden structural member.
Figure 1:
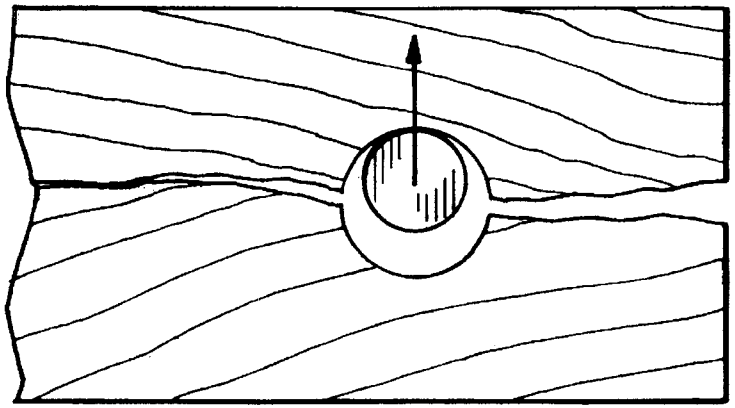
FIG. 1 (PRIOR ART)
FIG. 1 is a prior art top plan view of a non-reinforced end of a wooden structural member undergoing a force loading in the transverse direction which results in a catastrophic failure of the wooden structural member.

The invention is generally directed to reinforced wooden structural members and methods of manufacturing and connecting the same. Although the invention is primarily intended for bolted connections, other types of connections may be apparent to persons skilled in various arts. For example, a keyed cotter-pin connection or a lag-bolt connection would also be suitable for use with the reinforced wooden structural member of the present invention. In addition, any shape of wooden structural member may be the subject of the present invention. For example, typical construction timbers with square or rectangular shaped cross-sections, posts with circular shaped cross-sections, or others would be equally suitable for reinforcement according to the present invention. Hence, the following description of the present invention as applied to structural members with rectangular shaped cross-sections and bolted connections is illustrative and is not intended to limit the scope of the invention.

Briefly, a wooden substrate is bonded to a reinforcing material in areas of anticipated bolted connections in a sandwich-like configuration to form a reinforced wooden structural member. Suitable reinforcing materials, such as fiberglass sheets, fiber-reinforced plastic sheets, wood laminate sheets, thick coatings of epoxy resin or the like are applied to a wooden substrate with an appropriate adhesive or resin. The wooden substrate must be suitable for the particular structural application. Connection holes are drilled through the reinforced wooden structural member, either in advance or in the field, where the reinforced wooden structural member is connected to other structural members.

Alternatively, there are two other methods for producing reinforced wooden structural members. In one alternative method, connection apertures or holes may be predrilled into a wooden structural member and a reinforcement material then bonded to the wooden structural member with a suitable adhesive such that the reinforcement material covers the connection apertures contained in the wooden structural member. Once the adhesive has dried and cured, that portion of the reinforcement material covering the connection apertures is cut out or drilled out such that the holes in the reinforcement material are of the same circumference as, and in direct alignment with, the connection apertures contained within the wooden structural member.

In a second alternative method for producing a reinforced wooden structural member, connection apertures or holes are predrilled into a wooden structural member in areas of anticipated connections, holes having the same circumference as the connection apertures contained in the wooden structural member are precut or predrilled into a sheet of reinforcement material, and the sheet of reinforcement material is bonded to the wooden structural member such that the connection apertures contained in the wooden structural member are in direct alignment with the holes contained in the sheet of reinforcement material. Details of the present invention will now be addressed.

Figure 3:
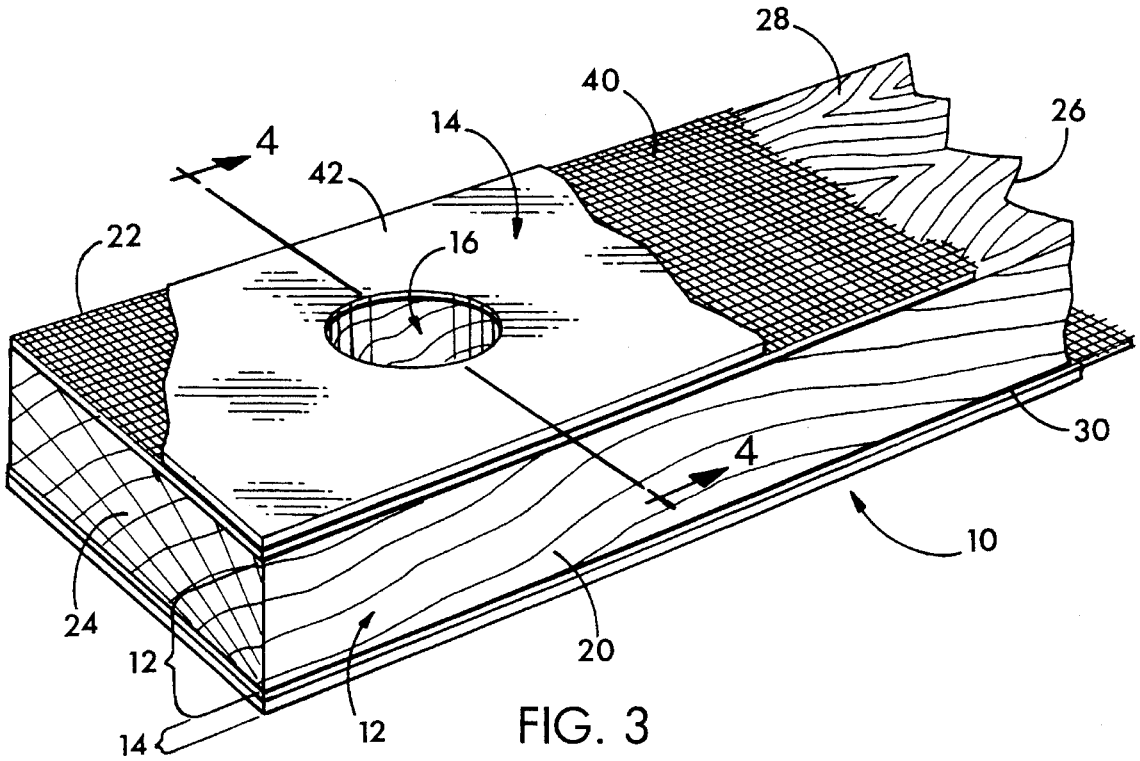
FIG. 3 is a perspective view of one end of a reinforced wooden structural member showing a reinforcing material bonded to a wooden substrate, where the reinforcing material is a fiberglass sheet embodiment of the present invention.
Figure 4:
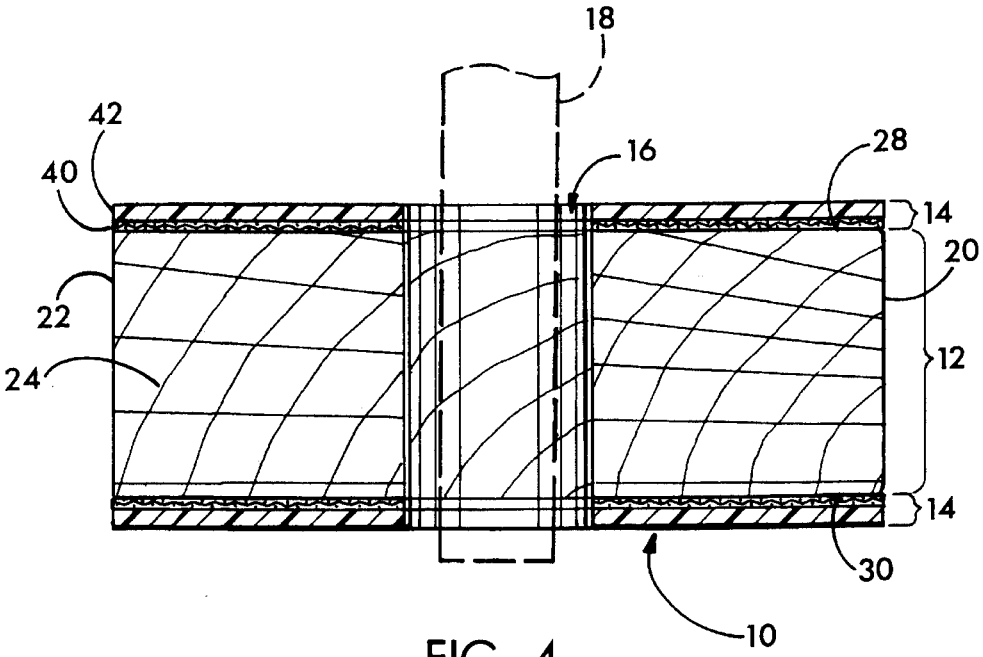
FIG. 4 is an end elevated cross-sectional view of a reinforced wooden structural member, shown with a bolted connection, taken along lines 4—4 of FIG. 3.

Reference is now made to the figures, wherein the same or similar features are numbered consistently throughout the several drawings. Referring now particularly to FIGS. 3 and 4, there is illustrated a wooden reinforced structural member 10. The wooden reinforced structural member 10 generally includes a wooden substrate 12, reinforcing material 14, and a connection aperture 16 suitable for receiving a connector 18.

The wooden substrate 12 may be selected of any shape, but should be of a strength suitable for the desired application. In a typical embodiment, as shown in FIGS. 3 and 4, the wooden substrate 12 is generally made up of opposing first and second sides 20, 22, opposing first and second ends 24, 26, and opposing first and second connection surfaces 28, 30. Prior to selecting anticipated connection sites and bonding the reinforcing material 14 to those connection surfaces 28, 30 which include the anticipated connection sites, the wooden substrate 12 is preferably prepared by planing the connection surfaces 28, 30 and lightly sanding the connection surfaces 28, 30 after planing. The planed and smoothed connection surfaces 28, 30 will facilitate a strong and even bonding of the reinforcing material 14 to the wooden substrate 12.

After selecting the wooden substrate 12 and planing and sanding the connection surfaces 28, 30 of the wooden substrate 12, areas of anticipated connections are identified. Several connections may be made within a single area and any number of areas of anticipated connections may exist on a single structural member. Typically, structural members are connected near their ends 24, 26 as shown in the embodiment of FIGS. 3 and 4.

The reinforcing material 14 is bonded to the first and/or second connection surfaces 28, 30, in the identified areas of anticipated connections. Several different reinforcing materials 14 are suitable for use in the present invention, including fiberglass sheets, fiber-reinforced plastic sheets, wood laminate sheets, a resin coating, or the like. These reinforcing materials 14 are bonded to the wooden substrate 12 using an appropriate bonding agent such as an epoxy resin or a phenolic type resin.

FIGS. 3 and 4 depict an embodiment of this invention in which the reinforcing material 14 comprises a fiberglass sheet 40 embedded in epoxy resin 42 and bonded to the connection surfaces 28, 30 of the wooden substrate 12 with the same epoxy resin 42. The fiberglass sheet 40 may be laid on substrate 12 first and the epoxy resin 42 laid on top of the fiberglass sheet in such as way as to ensure that the epoxy resin 42 permeates through the fiberglass sheet 40 to ensure contact between the epoxy resin and both the fiberglass sheet 40 and the substrate 12. Alternatively, the epoxy resin 42 could be deposited on the substrate 12 first followed by laying the fiberglass sheet 40 on the epoxy 42 resin in such a manner as to ensure that the epoxy resin 42 permeates thoroughly through the fiberglass sheet 40 to substrate 12. Thus, the respective placements of the fiberglass sheet 40 and the epoxy resin 42 are interchangeable provided the necessary amount of contact has been reached to achieve the desired result. Although the fiberglass sheet 40 is shown as being bidirectional, the fibers which are oriented parallel to the grain of the wooden substrate 12 are not functional in terms of load-carrying. A unidirectional fiberglass sheet would also be suitable if the fiberglass sheet is oriented such that its fibers are non-parallel to the grain of the wooden substrate 12.

Preferably, a sufficient number of layers of fiberglass should be used to achieve the equivalence of approximately 20–25 ounces per square foot of reinforcement. Typically, this is achieved using 3 layers of 7 oz fiberglass or 2 layers of 10 oz fiberglass. Commercial suppliers for the fiberglass sheets 40 and resin 42 include: Clark-Schwebel, 3M, and Johns-Mannsville. Any commercially available resins may be used to apply the fiberglass sheet 40 to the wooden substrate 12. Boat-building resins which are specifically designed for bonding fiberglass to a wooden substrate, such as those advertised under the trademark WEST SYSTEM ® and manufactured by Gougeon Brothers, Inc., are preferred. The precise epoxy resin (base and hardener) used will be determined by those skilled in the art. Significantly, the fiberglass sheet reinforcement material 14 need only be applied to either, or preferably both the first and second connection surfaces 28, 30. The reinforcement material 14 does not have to be applied at either of the ends 24, 26, nor to either of the sides 20, 22 of the wooden substrate 12. No gain in strength results from such end or side application, and in fact, such application may actually be undesirable due to the poor bonding which results from wrapping the fiberglass sheet reinforcing material 14 around the ninety degree (90°) corners of the substrate 12.

Figure 5:
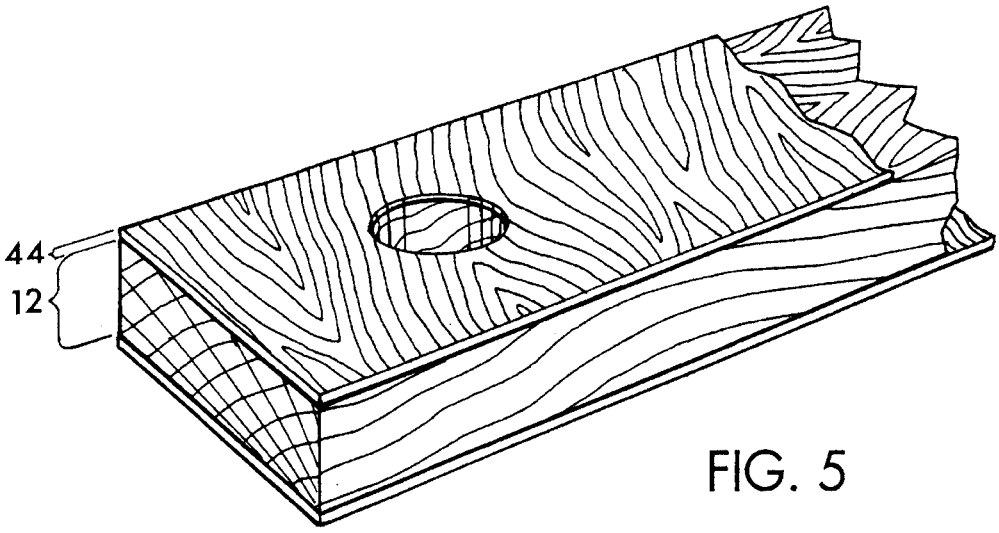
FIG. 5 is a perspective view of one end of a reinforced wooden structural member showing a reinforcing material bonded to a wooden substrate wherein the reinforcing material comprises a wood laminate sheet.
Figure 6:
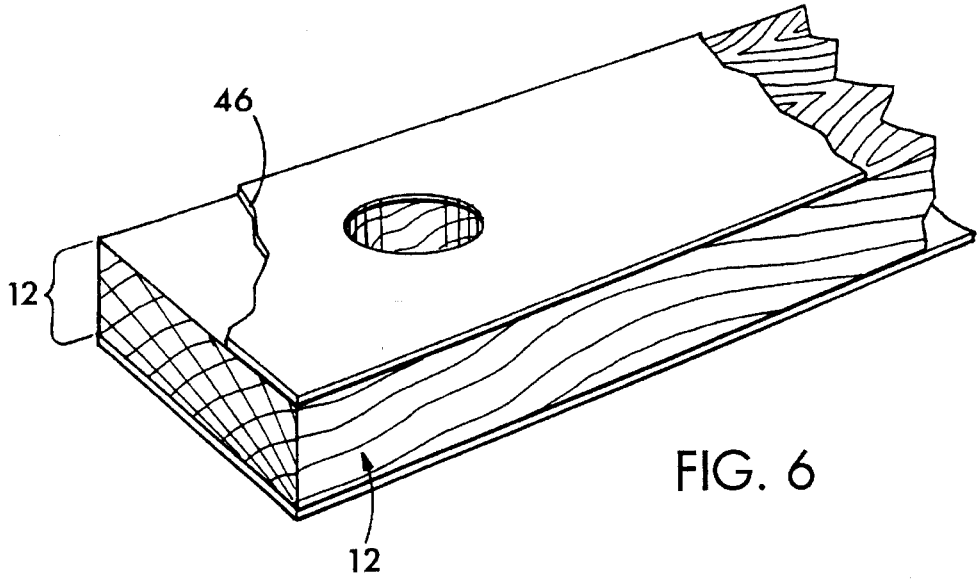
FIG. 6 is a perspective view of one end of a reinforced wooden structural member showing a reinforcing material comprises an epoxy resin coating.
Figure 7:
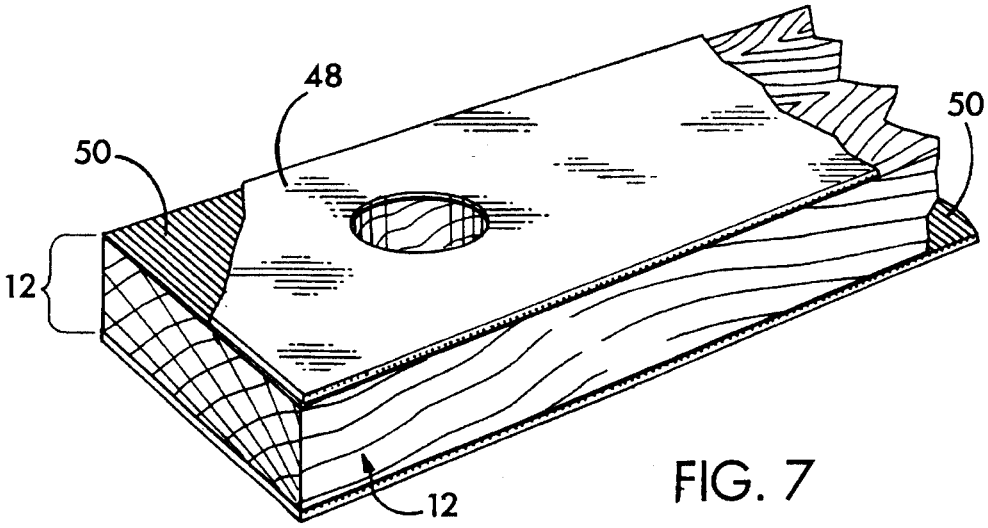
FIG. 7 is a perspective view of one end of a reinforced wooden structural member showing a reinforcing material bonded to a Wooden substrate wherein the reinforcing

FIGS. 5–7 depict embodiments of this invention in which other reinforcing materials 14 are bonded to the wooden substrate 12. Specifically, FIG. 5 depicts the use of a wood laminate sheet 44 as a reinforcement material. The wood laminate sheet 44 should be oriented such that its grain is non-parallel to the grain of the wood substrate 12. The preferred adhesives are those that can be cured in a wide-temperature range to yield a high-strength, rigid solid having excellent cohesive properties, outstanding bonding capabilities, and an adequate moisture vapor barrier. FIG. 6 depicts the use of an epoxy resin coating 46 as a reinforcement material. Any commercial epoxy resin which cures in a wide temperature range to produce a strong, water resistant solid is suitable.

FIG. 7 depicts the use of a fiber-reinforced plastic sheet 48 as a reinforcement material. Any commercially available fiber-reinforced plastic sheet material may be utilized for the invention. The fiber-reinforced plastic sheet 48 should be oriented such that its unidirectional fibers 50 are non-parallel to the grain of the wooden substrate 12. Again, any suitable adhesive may be used to bond the fiber-reinforced plastic sheet 48 to the wooden substrate 12. Those adhesives which can be cured in a wide range of temperatures to produce a high strength, water resistant bond are preferable.

Figure 8:
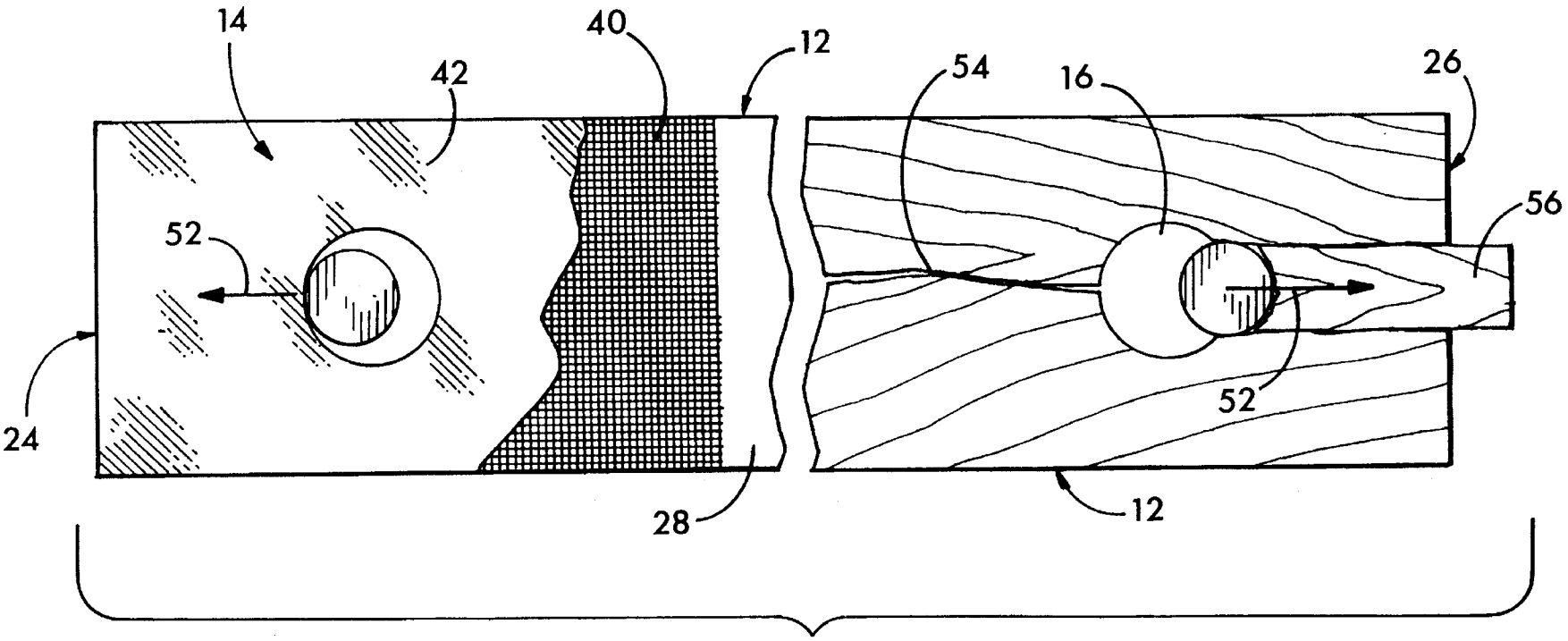
FIG. 8 is a top plan view of a wooden structural member which is reinforced with the fiberglass sheet embodiment of the present invention on one end, but non-reinforced on the opposing end, and which is undergoing testing with applied longitudinal loads.

The main advantage of this invention over the use of non-reinforced wooden structural members is illustrated in FIG. 8. A wooden structural member comprising a wooden substrate 12 is shown with a reinforced fiberglass sheet embodiment 14 of the present invention on a first end 24 and no reinforcement on an opposing second end 26. As previously shown with reference to FIG. 3, the reinforced fiberglass sheet embodiment 14 comprises a fiberglass sheet 40 embedded in epoxy resin 42. The reinforced fiberglass sheet embodiment 14 is bonded to the connection surface 28 of the wooden substrate 12 with the same epoxy resin 42.

Preferably, holes are drilled through the wooden substrate 12 and the reinforced fiberglass sheet 14 after any bonding agents, such as the epoxy resin 42, have fully cured. The bonding agent should fully cure to a solid state in approximately twenty to twenty-four hours after its application.

When a longitudinal load 52 is applied to the first end 24 of the wooden substrate 12 containing the reinforced fiberglass sheet embodiment 14 of the present invention, no catastrophic failure of the wooden structural member occurs. In contrast, when a longitudinal load 52 is applied to the second end 26 of the wooden substrate 12 which is void of the present invention, a catastrophic failure of the wooden structural member takes place. This catastrophic failure is evidenced by the crack 54 extending from the connection aperture 16, and the fractured member 56 which breaks off from the wooden substrate 12. The fractured member 56 is forced outward in the direction of the longitudinal load 52.

While preferred embodiments of the invention have been shown and described, it will be apparent to those skilled in the art that various modifications may be made in these embodiments without departing from the spirit of the present invention.

What is claimed is:

1. A structural member, comprising:

a. a wooden beam having grain directed along a length of said beam between ends, the beam having opposing faces generally parallel to the grain, at least one end having an aperture which extends between the opposing faces, the aperture suitable for receiving a connector; and b. a ductile fiber reinforcing material bonded to at least one opposing face only adjacent to said aperture, a majority of fibers of the fiber reinforcing material directed across the grain.

2. The structural member of claim 1, wherein the reinforcing material is bonded to the wooden substrate with an epoxy resin.

3. The structural member of claim 1, wherein the reinforcing material comprises a fiberglass sheet.

4. The structural member of claim 1, wherein the reinforcing material comprises a wood laminate sheet.

5. The structural member of claim 4, wherein the wood laminate sheet is oriented such that a grain of wood contained in the wood laminate sheet is non-parallel to a grain of wood contained in the wooden substrate.

6. The structural member of claim 1, wherein the reinforcing material comprises a coating of epoxy resin.

7. A process for manufacturing a wooden beam having grain directed along a length of the beam between ends, the beam having opposing faces generally parallel to said grain, at least one end of the beam having an aperture extending between the opposed faces and suitable for receiving a connector, the process comprising the step of:

bonding a ductile fiber reinforcing material only adjacent the aperture on at least one opposing face so that the majority of fibers are oriented across the grain, when so positioned, the reinforcing material limited to an area of each opposing face in the vicinity of said aperture.

8. The process of claim 7, wherein the reinforcing material is bonded to the wooden substrate with an epoxy resin.

9. The process of claim 7, wherein the reinforcing material comprises a fiberglass sheet.

10. The process of claim 7, wherein the reinforcing material comprises a wood laminate sheet.

11. The process of claim 7, wherein the reinforcing material comprises a coating of epoxy resin.

* * * * *